US005236049A

United States Patent [19]

Asselin et al.

[11] Patent Number: 5,236,049

[45] Date of Patent: Aug. 17, 1993

[54] FIRE EMERGENCY, SPRINKLING CONTROL SYSTEM AND METHOD THEREOF

[75] Inventors: Jean-Pierre Asselin, Blainville; Sylvain Coupal, Lachine; Claude Labonte, Laval; André LaPlante, Nantes; Yves Lauzier, St-Calixte, all of Canada

[73] Assignee: Securite Polygon Inc., St-Laurent, Canada

[21] Appl. No.: 813,261

[22] Filed: Dec. 24, 1991

[30] Foreign Application Priority Data

Feb. 22, 1991 [CA] Canada ..... 2036881

[51] Int. Cl.[5] ..... A62C 37/36; A62C 35/62; A62C 35/64; A62C 37/00

[52] U.S. Cl. ..... 169/61; 169/17; 169/20

[58] Field of Search ..... 169/17, 13, 20, 61

[56] References Cited

U.S. PATENT DOCUMENTS

| | | | |
|---|---|---|---|
| 406,087 | 7/1889 | Clapp | 169/20 |
| 480,747 | 8/1892 | Shaffer | 169/20 |
| 869,415 | 10/1907 | Buell | 169/20 |
| 1,900,632 | 3/1933 | Boardman | 169/20 X |
| 2,334,826 | 11/1943 | Lowe | 169/17 |
| 2,421,303 | 5/1947 | Van Houten | 169/17 |
| 3,100,017 | 8/1963 | Johnson . | |
| 3,958,643 | 5/1976 | Landsberg | 169/20 X |
| 4,005,754 | 2/1977 | Linden et al. . | |
| 4,091,874 | 5/1978 | Monma . | |
| 4,204,201 | 5/1980 | Williams et al. . | |
| 4,267,889 | 5/1981 | Williams . | |
| 4,305,469 | 12/1981 | Morrisette . | |
| 4,401,976 | 8/1983 | Stadelmayr . | |
| 4,570,719 | 2/1986 | Wilk . | |
| 4,597,451 | 7/1986 | Moore et al. . | |
| 4,725,820 | 2/1988 | Kimura . | |
| 4,754,266 | 6/1988 | Shand et al. . | |
| 5,027,905 | 7/1991 | Cousineau et al. | 169/17 |
| 5,117,916 | 6/1992 | Ohta et al. | 169/61 X |

*Primary Examiner*—David M. Mitchell
*Assistant Examiner*—James M. Kannofsky
*Attorney, Agent, or Firm*—Collard & Roe

[57] ABSTRACT

There is described an electronic fire reporting and sprinkling control module to be connected to a control bus of a fire alarm system, and to a flow control valve which controls flow of extinguishing fluid into a sprinkler system. The sprinkler system can be monitored by pressurized air. The module comprises a bus connection, detector input connections, an air pressure detector connection to provide a status signal representative of pressure inside the sprinkler system, a detection mode unit having inputs connected to the detector input connections, a pre-programmed sprinkling mode unit for generating a sprinkler signal according to a pre-programmed operation mode and the status signal present at the air pressure input connection, a timer for initiating sprinkling periods as long as its input is activated, and a valve control unit having a first input for receiving an output signal from the timer, and an output for activating the flow control valve, whereby information concerning a fire emergency can be directly transmitted to the fire alarm system by means of the control bus connection, whereby fire emergency conditions in an area can be set by means of a group of detectors and the detection mode unit, and whereby automatic sprinkling periods can be programmed by means of the timer. There is also described a flow control valve system, and a method of controlling the flow control valve.

13 Claims, 7 Drawing Sheets

FIRE EMERGENCY, SPRINKLING CONTROL SYSTEM AND METHOD THEREOF

FIELD OF THE INVENTION

The present invention relates to an electronic fire reporting and sprinkling control module to be connected to a control bus of an alarm system, and to a flow control valve which controls flow of extinguishing fluid into a sprinkler system. The sprinkler system can be monitored by pressurized air, the sprinkler system covering a particular area to be protected. The present invention also relates to a flow control valve system for controlling flow of extinguishing fluid into a sprinkler system which can be monitored by pressurized air. The system can be connected to a sprinkling control module which commands the flow of fluid into the sprinkler system upon detection of a fire emergency. The present invention also relates to a method of controlling a flow control valve system that controls flow of extinguishing fluid into a sprinkler system which is monitored by pressurized air. The system is connected to a sprinkling control module which commands the flow of fluid into the sprinkler system upon detection of a fire emergency.

BACKGROUND OF THE INVENTION

There are many types of fire protection systems presently on the market. A complete fire protection system known as the "FIRECYCLE" system, U.S. Pat. No. 3,100,017 by J. E. JOHNSON et al., owned by VIKING FIRE PROTECTION COMPANY, Kansas City, U.S.A., represents the closest comparison to the present invention. This system however has some shortcomings. The "FIRECYCLE" system does not have a ground fault detection circuit, and causes the immediate operation of the mechanical system on complete electrical power loss. Also, it operates under one operation mode only. It also uses 120 VAC bells which cannot operate when the system is under 24 VDC battery power, and finally, the main water inlet valve is not supervised. Another system made by LINDEN et al., U.S. Pat. No. 4,005,754, consists of operations similar to the present invention, but it is made for only one operation mode. It has no supervisory circuit and the detection lines are not supervised. Also known in the art are the following U.S. Pat. Nos. 4,091,874, by MONMA (1978); 4,204,201, by WILLIAMS et al. (1980); 4,267,889, by WILLIAMS (1981); 4,305,469, by MORRISETTE (1981); 4,401,976, by STADELMAYR (1983); 4,570,719, by WILK (1986); 4,597,451, by MOORE et al. (1986); 4,725,820, by KIMURA (1988); and 4,754,266, by SHAND et al. (1988).

OBJECTS OF THE INVENTION

An object of the present invention is to provide an electronic fire reporting and sprinkling control module by which information concerning a fire emergency can be directly transmitted to a remote alarm system by means of a control bus connection, by which fire emergency conditions in an area to be protected can be set by means of a group of detectors and a detection unit, and by which automatic sprinkling periods can be programmed by means of a timer.

Another object of the present invention is to provide a flow control valve system for controlling flow of extinguishing fluid into a sprinkler system which can be monitored by pressurized air, by which upon complete electrical power loss and air pressure drop inside the sprinkler system, introduction of extinguishing fluid is allowed inside the sprinkler system.

Another object of the present invention is to provide a method of controlling a flow control valve system that controls flow of extinguishing fluid into a sprinkler system which is monitored by pressurized air, by which upon complete electrical power loss and air pressure drop inside the sprinkler system, the flow control valve is activated thus allowing introduction of extinguishing fluid inside the sprinkler system.

The objects, advantages and other features of the present invention will become more apparent upon reading of the following non restrictive description of a preferred embodiment thereof, given for the purpose of exemplification only, with reference to the accompanying drawings.

SUMMARY OF THE INVENTION

According to the present invention, there is provided an electronic fire reporting and sprinkling control module to be connected to a control bus of a fire alarm system, and to a flow control valve which controls flow of extinguishing fluid into a sprinkler system, said sprinkler system can be monitored by pressurized air, said sprinkler system covering a particular area to be protected, comprising:

a bus connection to be connected to said control bus for receiving and transmitting information from and to said fire alarm system;

detector input connections to be connected to at least one group of detectors that monitor said area covered by said sprinkler system;

an air pressure detector connection to be connected to an air pressure detector that can provide a status signal representative of pressure inside said sprinkler system if monitored by pressurized air;

a detection mode unit having inputs connected to said detector input connections, and an output for generating an alarm signal when pre-selected inputs of said detection mode unit are activated;

a pre-programmed sprinkling mode unit having a first input connected to the output of said detection mode unit, a second input connected to said air pressure input connection, and an output for generating a sprinkler signal according to a pre-programmed operation mode and said status signal present at said air pressure input connection;

a timer having an input for receiving an initiating signal derived from said sprinkler signal, and an output for initiating sprinkling periods as long as its input is activated; and a valve control unit having a first input for receiving an output signal from said timer, and an output for activating said flow control valve, whereby information concerning a fire emergency can be directly transmitted to said alarm system by means of said control bus, whereby fire emergency conditions in said area can be set by means of said at least one group of detectors and said detection mode unit, and whereby automatic sprinkling periods can be programmed by means of said timer.

Also, according to the present invention, there is provided a flow control valve system for controling flow of extinguishing fluid into a sprinkler system which can be monitored by pressurized air, said system can be connected to a sprinkling control module which commands said flow of fluid into said sprinkler system upon detection of a fire emergency, said flow control valve system comprises:

a main valve having an inlet for receiving said fluid, and an outlet;

a flow control valve having an inlet connected to the outlet of said main valve, and an outlet to be connected to said sprinkler system by means of a check valve restricting flow of pressurized air from said sprinkler system to said flow control valve, said control valve having a body forming a passage between the inlet and the outlet of said control valve, said control valve including movable clapper having a first position in which said passage is blocked, and a second position in which said passage is open, said clapper having a first surface forming with said body a chamber having inlet and outlet receiving and exiting respectively pressurized fluid, said clapper having a second opposite surface forming with said body said inlet of said flow control valve, said first surface being at least four times greater than said second surface, said clapper being moved from its second position to its first position by means of said pressurized fluid entering said inlet of said chamber, said clapper being moved from its first position to its second position by releasing pressurized fluid from said outlet of said chamber;

a pressurized air channel having an inlet to be connected to a pressurized air source, and an outlet to be connected to said sprinkler system by means, respectively, of a pressure operated release valve and a check valve for restricting fluid from circulating from the sprinkler system to the air channel;

a normally closed valve having an end derived from said chamber of said control valve for depressurizing said chamber when activated, said normally closed valve can be controlled by said module;

a fluid releasing circuit derived from said chamber, including a normally open valve and a pneumatic actuator which is controlled by air pressure inside the air channel, said actuator being closed when said air channel is pressurized and opened when pressure drops inside said air channel, said normally open valve can be controlled by said module;

a priming system including a priming valve having an inlet connected to a source of fluid and an outlet connected to said chamber by means of a channel having a portion with a reduced cross-section;

a fluid flow detector and activating means for detecting fluid flow at the outlet of said control valve and activating said pressure operated release valve upon fluid flow detection; and an air pressure detector for indicating to said module that air pressure has dropped under a predetermined level inside said air channel, said normally open and closed valves can be connected to said module for controlling said flow control valve upon detection of a fire emergency by said module, whereby upon complete electrical power loss and air pressure drop inside said sprinkler system, said chamber is depressurized thus allowing introduction of extinguishing fluid inside said sprinkler system.

Also, according to the present invention, there is provided a method of controlling a flow control valve system that controls flow of extinguishing fluid into a sprinkler system which is monitored by pressurized air, said system is connected to a sprinkling control module which commands said flow of fluid into said sprinkler system upon detection of a fire emergency, comprising steps of:

receiving said fluid by means of a main valve;

sending said fluid from said main valve to an inlet of a flow control valve, an outlet of said flow control valve being connected to said sprinkler system by means of a check valve restricting flow of pressurized air from said sprinkler system to said flow control valve, said flow control valve having a first position in which said fluid is blocked, and a second position in which said fluid is free to flow, said flow control valve being moved from its second position to its first position by means of a pressurized controlling fluid sent to said flow control valve, said flow control valve being moved from its first position to its second position by releasing said pressurized controlling fluid from said flow control valve;

pressurizing said sprinkler system by means of a pressurized air channel including, respectively, a pressure operated release valve for depressurizing said air channel when a flow of said extinguishing fluid is detected at said outlet of said flow control valve, and a check valve for restricting fluid from circulating from the sprinkler system to the air channel;

depressurizing said flow control valve by activating a normally closed valve that releases said pressurized controlling fluid when said fire emergency is detected;

depressurizing said flow control valve by means of a normally open valve connected in series with a pneumatic actuator that is open only when pressure drops inside said air channel, said normally open valve being closed when a reset has been done after said fire emergency;

pressurizing said flow control valve by means of a priming system including a priming valve to send said pressurized controlling fluid to said flow control valve by means of a channel having a portion with a reduced cross-section; and detecting fluid flow at the outlet of said control valve and depressurizing said air channel upon fluid flow detection, whereby upon complete electrical power loss and air pressure drop inside said sprinkler system, said flow control valve is depressurized, thus allowing introduction of extinguishing fluid inside said sprinkler system.

DETAILED DESCRIPTION OF THE DRAWINGS

Figure 1:
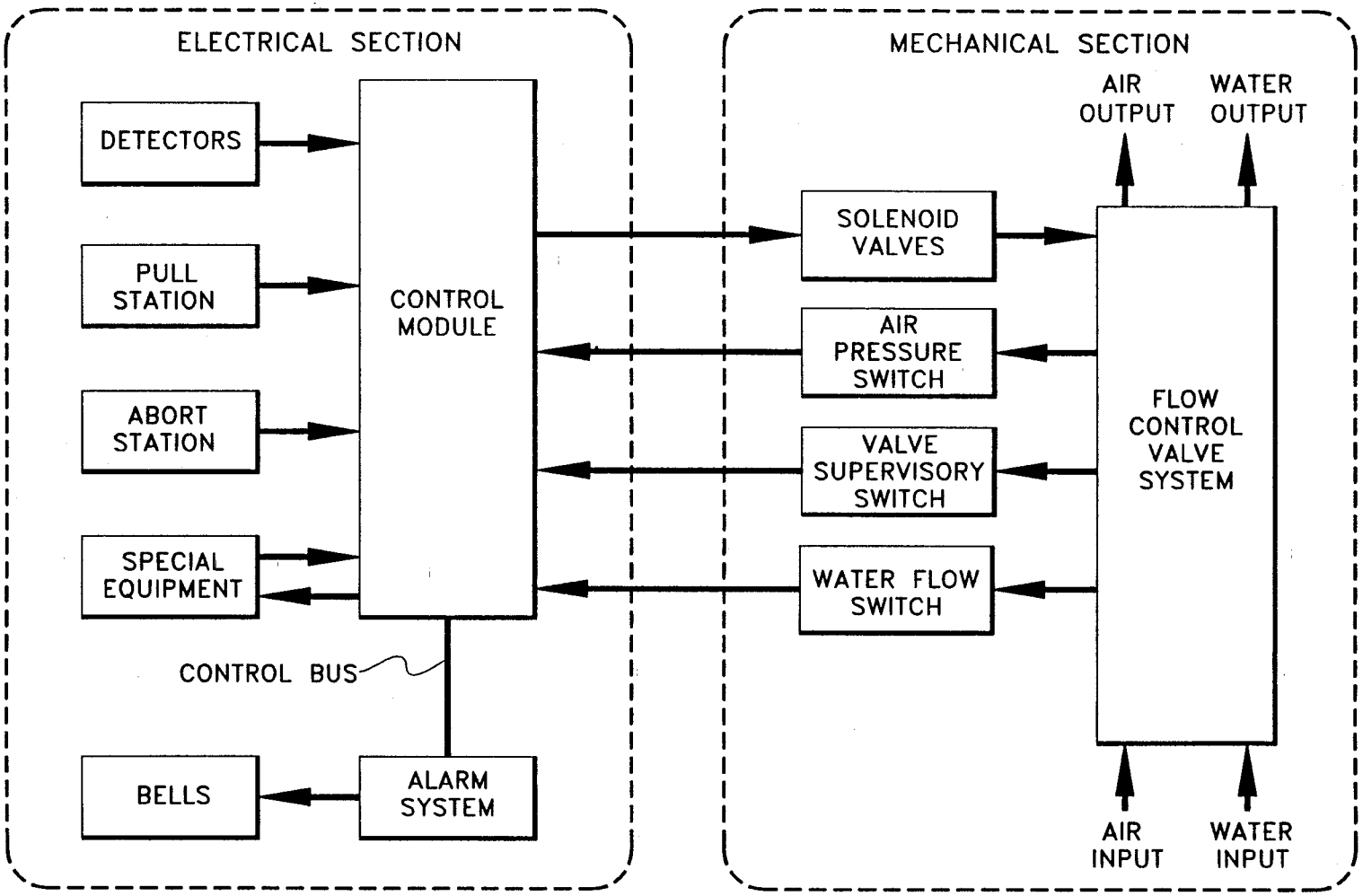
FIG. 1 is a block diagram illustrating in a general manner the main components of a fire emergency system according to the present invention.

Referring now to FIG. 1, there is shown in block diagram a general view of an automatic fire extinguishing system. This system comprises an electrical section and a mechanical section. The electrical section comprises an electronic control module onto which is connected, for example, as shown in FIG. 1, detectors, a pull station, an abort station, and a special equipment that must not be sprinkled when in operation. This special equipment might consist of high power transformer which can be seriously damaged if sprinkled when operating. This special equipment can receive a request for sprinkling signal and can provide a confirmation signal indicating that the equipment is not operating and a sprinkling can be performed.

The control module is also connected to a fire alarm system by means of a control bus. This alarm system can control bells, for example as shown in FIG. 1.

The system also comprises a mechanical section having a flow control valve system which is provided with inputs to be connected respectively to a source of water and a source of air. The flow control valve system has a water output for providing water to a sprinkler system, and an air output for pressurizing the sprinkler system with air. The mechanical section also comprises solenoid valves by which the water output can be controlled. These solenoid valves are controlled by the control module. An air pressure switch is provided for monitoring the sprinkler system. The output of this air pressure switch is connected to the control module. A valve supervisory switch is connected to the flow control valve system for monitoring the status of the main valve that controls the water input of the flow control valve system. The output of this valve supervisory switch is connected to the control module. A water flow switch is also provided for monitoring flow of water into the water output. The output of this water flow switch is connected to the control module.

Figure 2A:
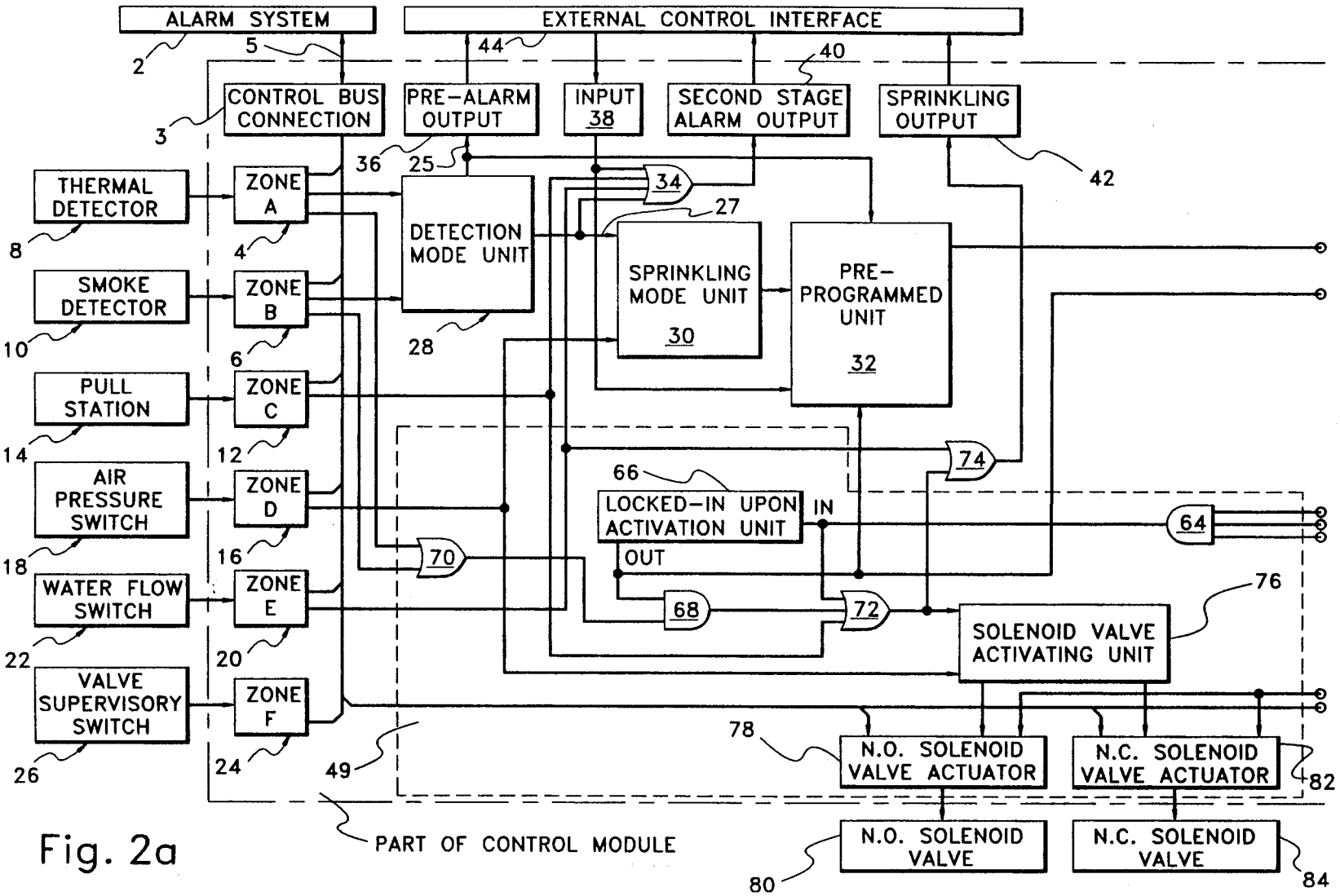
FIGS. 2*a* and 2*b* are a block diagram illustrating with more details the control module shown on FIG. 1.
Figure 2B:
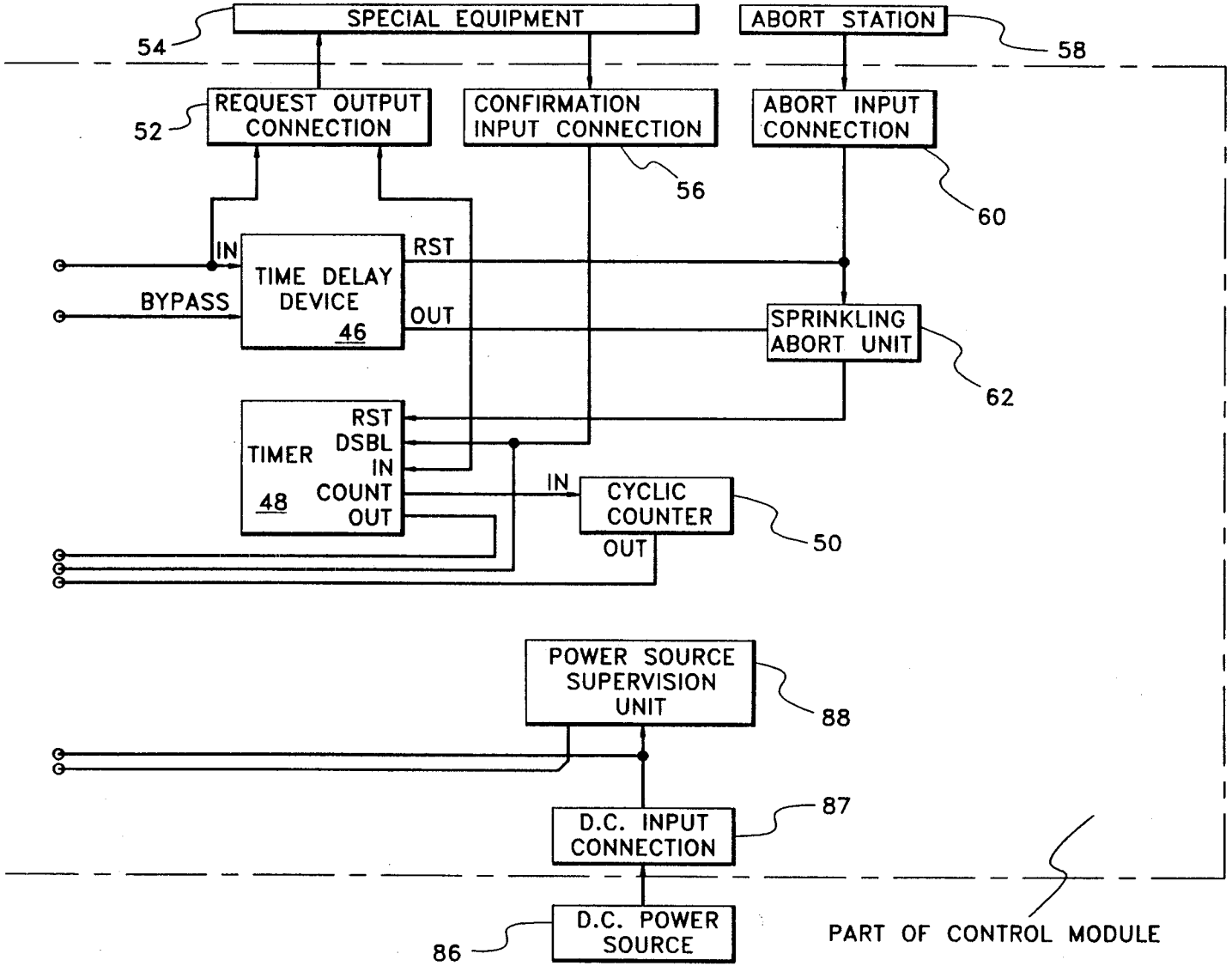

Referring now to FIGS. 2*a* and 2*b*, there is shown with more details the control module shown on FIG. 1, and the components that are directly connected to this control module. This control module comprises a bus connection 3 to be connected to the control bus 5 of a fire alarm system 2 for receiving and transmitting information from and to the alarm system 2. Detector input connections constituting zone A 4 and zone B 6 are connected respectively to at least one thermal detector 8 and one smoke detector 10. The thermal detector 8 and the smoke detector 10 monitor the area covered by the sprinkler system that is controlled by the present module. An air pressure detector connection constituting zone D 16 is also provided. It is connected to an air pressure switch 18 that can provide a status signal representative of pressure inside the sprinkler system if such sprinkler is monitored by pressurized air. The detector input connections constituting zone A 4 and zone B 6, and the air pressure detector connection constituting zone D 16 are connected to the control bus connection 3.

The control module is also provided with an emergency input connection constituting zone C 12. It is connected to an emergency pull station 14. An output of zone C 12 is also connected to the control bus connection 3. A water flow input connection constituting zone E 20 is also provided. It is connected to a water flow switch 22 monitoring flow of fluid inside the sprinkler system. An output of zone E is connected to the control bus connection 3. Also, the module comprises a valve input connection constituting zone F 24. It is connected to a valve supervisory switch 26 monitoring a main valve that controls access of the extinguishing fluid to the flow control valve (not shown on FIGS. 2*a* and 2*b*). The zone F 24 is connected to the bus connection 3. The zones are connected to the control bus connection 3 so that the fire alarm system can be informed of different operating statuses.

The control module comprises a detection mode unit 28 having a first input connected to the output of the zone A 4 and zone B 6. The detection mode unit 28 can be programmed to provide a positive signal at its output 25 when zone B 6 is activated, and a positive signal at its output 27 when zone A 4 and zone B 6 are activated. A pre-programmed sprinkling mode unit 30 is provided for generating a sprinkler signal according to a pre-programmed operation mode and the status signal present at zone D 16. This sprinkling mode unit 30 has a first input connected to the output 27 of the detection unit 28, and a second input connected to an output of zone D 16. The module also comprises a timer 48 having an input for receiving an initiating signal derived from the sprinkler signal present at the output of the sprinkling mode unit 30, and an output for initiating sprinkling periods as long as its input is activated.

A valve control unit 49 is also provided. It has a first input for receiving an output signal from the timer 48, and an output for activating a flow control valve (not shown on FIGS. 2*a* and 2*b*) by means of a normally open solenoid valve 80 and a normally closed solenoid valve 84. Information concerning a fire emergency can be directly transmitted to the alarm system by means of the control bus connection 3. The fire emergency conditions in the area to be protected can be set by means of the detection mode unit 28 and the thermal and smoke detectors 8 and 10. Automatic sprinkling periods can be programmed by means of the timer 48. A cyclic counter 50 is provided for counting each of the sprinkling periods. The counter 50 has an input connected to an output of the timer 48, and an output connected to a second input of the valve control unit 49. A stop of sprinkling after a predetermined amount of the sprinkling periods can be programmed by means of the counter 50.

The valve control unit 49 comprises a first AND gate 64 having inputs constituting the first and second inputs of the valve control unit 49; a locked-in upon activation unit 66 having an input connected to the output of the first AND gate 64; a second AND gate 68 having a first input connected to the output of the locked-in upon activation unit 66, a second input connected to the output of a first OR gate 70 which has inputs connected to the zone A 4 and zone B 6; and a second OR gate 72 having a first input connected to the output of the first AND gate 64, a second input connected to the output of the second AND gate 68, and a third input connected to the zone C 12. The valve control unit 49 also comprises a solenoid valve activating unit 76 having a first input connected to the output of the second OR gate 72, a second input connected to the zone D 16, a first output for activating a normally open solenoid valve actuator 78 and a second output for activating a normally closed solenoid valve actuator 82. The solenoid valves 80 and 84 are controlled by the valve activating unit 76 according to different conditions determined by signals present on zones A, B, C and D and by signals derived from the output of the sprinkling mode unit 30.

The control module also comprises a direct current power input connection 87 to be connected to a direct current power source 86. The input connection 87 is connected to each of the valve actuators 78 and 82 by which their corresponding valve 80 or 84 can be energized by the direct current power source 86 when activated. A power source supervision unit 88 is provided. It has an input connected to the input connection 87, and an output connected to the bus connection 3 by which the control bus can be informed of the status of the direct current power input connection 87. The actuators 78 and 82 are also connected to the control bus connection 3 so that the alarm system can be informed of the status of these actuators 78 and 82.

The present module can be connected, for example, as shown in FIGS. 2*a* and 2*b* to an external control interface. This external control interface can provide an external activation signal and can receive different signals indicative of different status signals inside the module. To communicate with this external control interface, the control module comprises a pre-alarm output having an input connected to the output 25 of the detection mode unit 28; an input 38 for receiving an external activation signal from the external control interface; a second stage alarm output having an input connected to the output of a OR gate 34 which has its inputs connected respectively to the input 38, an output of the zone C 12, an output of the zone E 20, and the output 27 of the detection mode unit 28; and a sprinkling output 42 having its input connected to the output of a OR gate 74 which has its inputs connected to an output of the zone E 20 and the output of the OR gate 72.

The module also comprises a pre-programmed unit 32 relating to options concerning an external activation by means of the external control interface. This pre-programmed unit 32 has an input connected to the output 25 of the detection mode unit 28, an input connected to the output of the sprinkling mode unit 30, an input connected to the input 38, and an input connected to the output of the locked-in upon activation unit 66. The output of the pre-programmed unit 32 is connected to a timer delay device 46 which has an input for receiving an activating signal from the unit 32, an output connected to the input of the timer 48 to provide the initiating signal of the timer, a by-pass input connected to the output of the locked-in upon activation unit by which the initiating signal of the timer 48 has substantially no time delay with respect to the activating signal of the delay device 46 when the by-pass input is activated. The initiating signal has a predetermined time delay with respect to the activating signal of the timer 48 when the by-pass input is not activated. This device 46 is also provided with a reset input for resetting it when activated.

The present module can be connected, for example, as shown in FIGS. 2*a* and 2*b* to a special equipment located in the area to be protected. This special equipment must not be sprinkled when in operation, the special equipment can receive a request for sprinkling signal and can provide a confirmation signal indicating that the equipment is not operating and a sprinkling can be performed. To this effect, the module comprises a request output connection 52 for receiving a first signal from the input of the delay device 46 and a second signal from the output of the delay device 46. The request output connection can be programmed to send the request for sprinkling signal to the special equipment before the time delay provided by the device 46 or after such time delay. A confirmation input connection 56 is provided for receiving the confirmation signal from the equipment. The confirmation input connection is connected to a disabling input of the timer 48 and to a third input of the first AND gate 64.

The module also comprises an abort input connection 60 to be connected to an abort station 58. The abort input connection 60 is connected to the reset input of the delay device 46. This abort input connection 60 is also connected to a sprinkling abort unit 62 having an input connected to the output of the delay device 46, and an output connected to a reset input of the timer 48 by which a sprinkling can be aborted by activation of the abort station 58.

Figure 3:
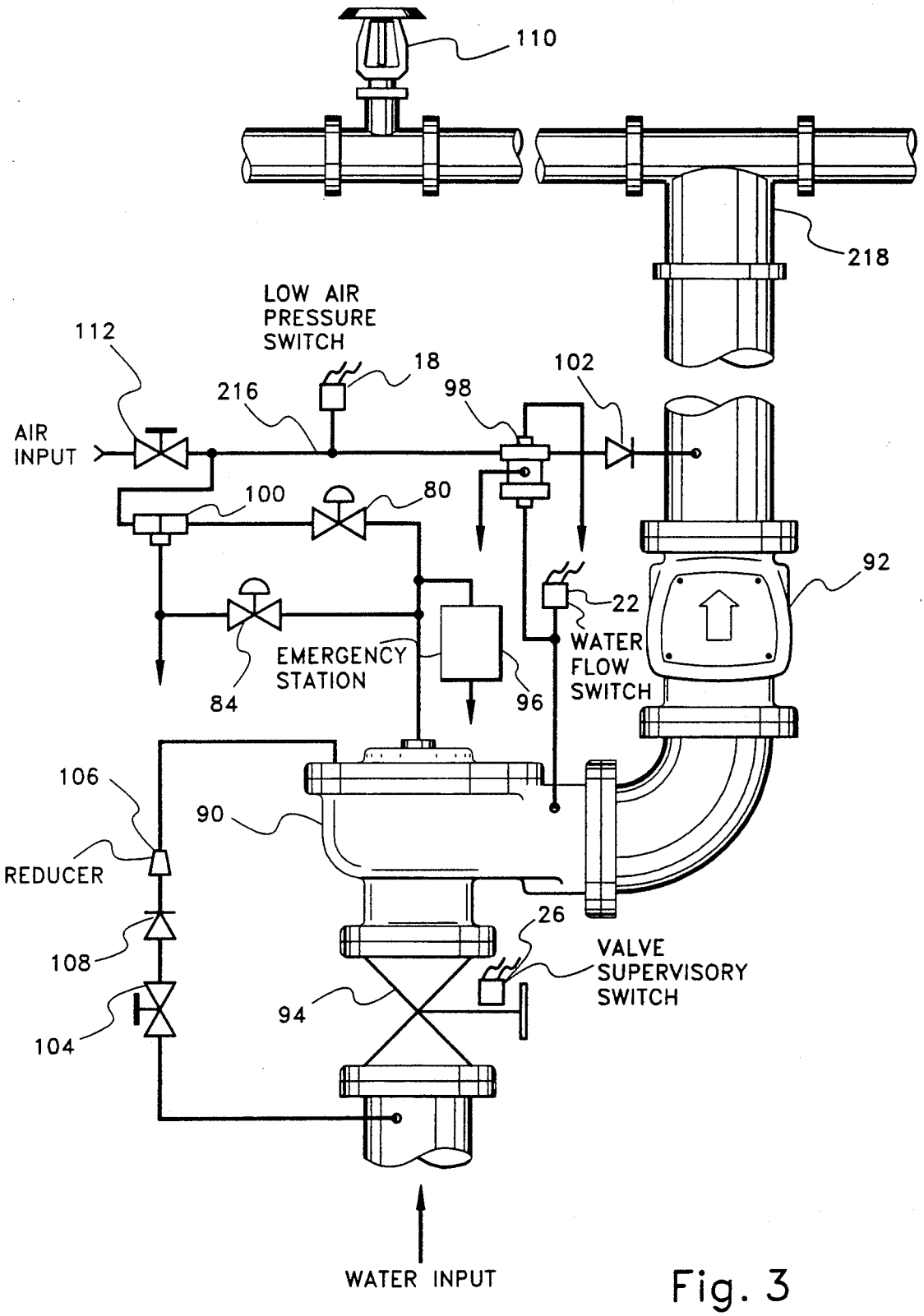
FIG. 3 is a schematic diagram illustrating with more details the mechanical section shown on FIG. 1.
Figure 4:
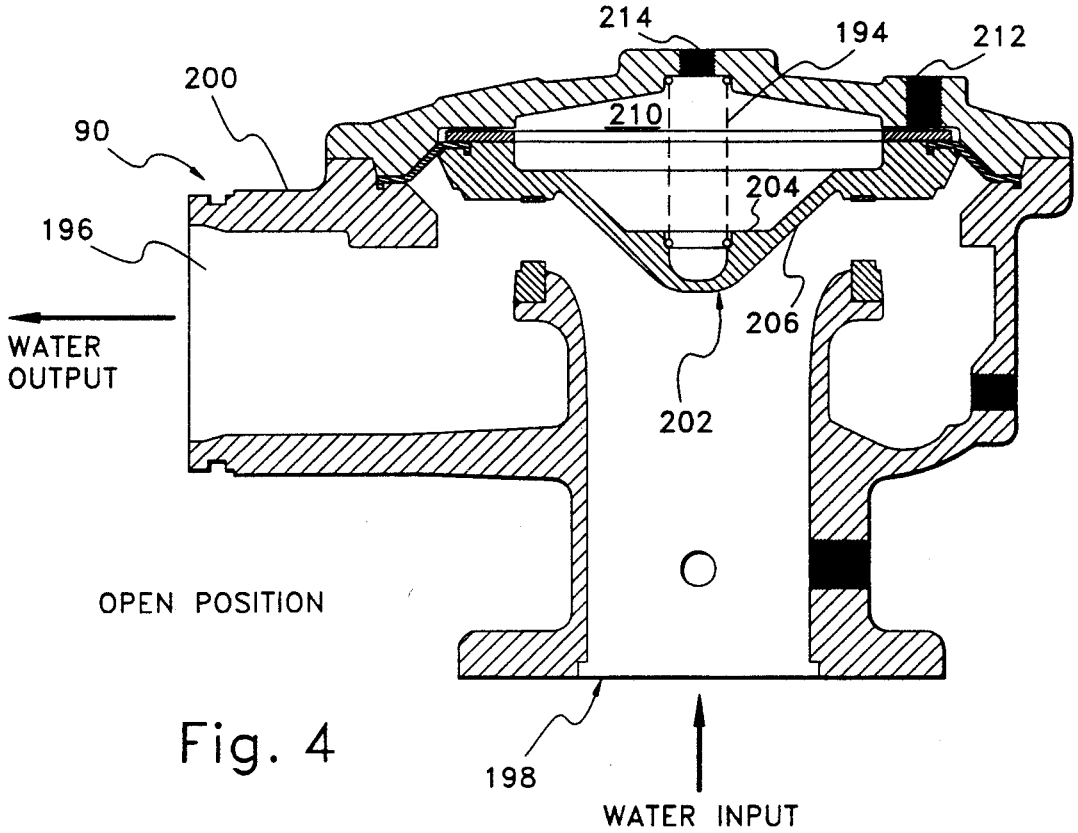
FIG. 4 is a front view in cross-section of the flow control valve shown on FIG. 3 in its open position.
Figure 5:
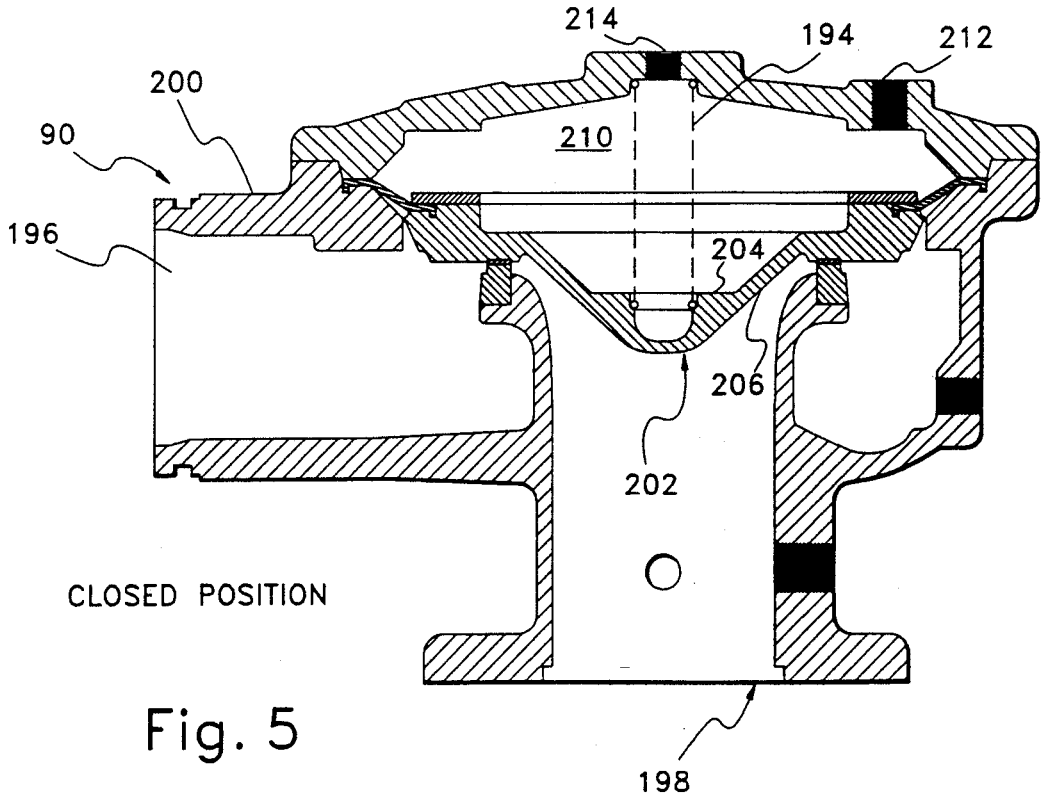
FIG. 5 is a front view in cross-section of the flow control valve shown on FIG. 3 in its closed position.

Referring to FIGS. 3, 4 and 5, there is shown a flow control valve system for controlling flow of extinguishing fluid into the sprinkler system which can be monitored by pressurized air. The present flow control valve system can be connected to the sprinkling control module shown on FIGS. 2*a* and 2*b* which commands the flow of fluid into the sprinkler system upon detection of a fire emergency.

The present flow control valve system comprises a main valve 94 having an inlet for receiving the fluid, and an outlet. A flow control valve 90 is provided. It has an inlet connected to the outlet of the main valve 94, and an outlet connected to the sprinkler system by means of a check valve 92 restricting flow of pressurized air from said sprinkler system to the control valve 90. The control valve has a body 200 forming a passage between the inlet 198 and the outlet 196 of the control valve 90. The control valve 90 includes a movable clapper 202 having a first position, shown in FIG. 5, in which the passage is blocked, and a second position, shown on FIG. 4, in which the passage is open. The clapper 202 has a first surface 204 forming with the body 200 a chamber 210 having an inlet 212 and an outlet 214 receiving and exiting respectively pressurized fluid. The clapper 202 has a second opposite surface 206 forming with the body the inlet of the flow control valve 90. The first surface 204 is at least four times greater than the second surface 206. The clapper 202 is moved from its second position to its first position by means of the pressurized fluid entering the inlet 212 of the chamber 210. The clapper 202 is moved from its first position to its second position by releasing the pressurized fluid from the outlet 214 of the chamber 210.

A pressurized air channel 216 is also provided. This channel 216 has an inlet provided with an air valve 112 to be connected to a pressurized air source, and an outlet to be connected to the sprinkler system 218 by means, respectively, of a pressure operated release valve 98 and a check valve 102 for restricting fluid from circulating from the sprinkler system 218 to the air channel 216. A normally closed valve 84 is provided. It has an end derived from the chamber 210 of the control valve 90 for depressurizing the chamber 210 when activated. This valve 84 is controlled by the module shown on FIGS. 2*a* and 2*b*.

A fluid releasing circuit derived from the chamber 210 is also provided. This circuit includes a normally open valve 80 and a pneumatic actuator 100 which is controlled by air pressure inside the air channel 216. This actuator 100 is closed when the air channel is pressurized and open when pressure drops inside the channel 216. This normally open valve 80 is controlled by the module shown on FIGS. 2*a* and 2*b*.

A priming system is also provided, this system comprising a priming valve 104 having an inlet connected to the inlet of the main valve 94 so that a source of fluid is provided, and an outlet connected to the chamber 210 by means of a channel having a portion 106 with a reduced cross-section and a check valve 108 for restricting fluid from circulating from the chamber 210 to the priming valve 104.

A fluid flow detector and activating means is also provided for detecting fluid flow at the outlet of the control valve 90 and activating the pressure operated release valve 98 upon fluid flow detection. A low air pressure switch is provided for indicating to the module shown on FIGS. 2*a* and 2*b* air pressure has dropped under a predetermined level inside the air channel 216. The normally open and closed valves 80 and 84 are connected to the module shown on FIGS. 2*a* and 2*b* for controlling the flow control valve 90 upon detection of a fire emergency by the module. Upon complete electrical power loss and air pressure drop inside the sprinkler system 218, the chamber 210 is depressurized, thus allowing introduction of extinguishing fluid inside the sprinkler system 218.

It is preferable that, along the fluid releasing circuit, the normally open valve 80 be disposed between the chamber 210 and the pneumatic actuator 100.

The present flow control valve system also comprises a valve supervisory switch 26 installed onto the main valve 94, and having an output connected to the module shown on FIGS. 2*a* and 2*b* by which the module can be informed of the status of the main valve 94. A water flow switch 22 is also provided. It has an input derived from the outlet of the flow control valve, and an output connected to the module shown on FIGS. 2*a* and 2*b* by which the module is informed whether fluid has been introduced in the sprinkler system 218.

A method of controlling the flow control valve system is also provided. This method comprises steps of receiving the fluid by means of the main valve 94, sending the fluid from the main valve 94 to an inlet of the flow control valve 90, pressurizing the sprinkler system by means of the pressurized air channel 216 including, respectively, a pressure operated release valve for depressurizing the air channel when a flow of the extinguishing fluid is detected at the outlet of the flow control valve, and a check valve, depressurizing the flow control valve 90 by activating a normally closed valve 84 when a fire emergency is detected, and depressurizing the flow control valve 90 by means of the normally open valve 80 connected in series with the pneumatic actuator 100 that is open only when pressure drops inside the air channel 216.

The method also comprises steps of pressurizing the flow control valve 90 by means of the priming system that includes among other things the priming valve 104, detecting fluid flow at the outlet of the control valve 90 and depressurizing the air channel upon fluid flow detection, whereby upon complete electrical power loss and air pressure drop inside the sprinkler system, the flow control valve 90 is depressurized, thus allowing introduction of extinguishing fluid inside the sprinkler system.

Referring now to FIGS. 4 and 5, there is shown the flow control valve 90. There are shown the valve inlet 198 and the valve outlet 196 (normally dry) on the left hand side. The outlet 196 and the top chamber 210 of the valve 90 are separated from the water inlet 198 by a rigid clapper 202. This clapper 202 is maintained in the closed position (shown on FIG. 5) by the water pressure in the system which is diverted to the top chamber 210. A two to one pressure differential on the clapper 202 between the top chamber 210 and the water inlet 198 maintains the water tightness of the clapper 202 by keeping it closed. The valve 90 may be opened by releasing the pressure on the top chamber 210. The water supply pressure beneath the clapper 202 is now greater than the pressure above the clapper 202 and causes the valve 90 to open. To close the valve 90, we simply have to rebuild the pressure inside the top chamber 210. Since the surface of the clapper 202 on the top chamber side is equal to that of the water inlet 202, a spring 194 allows the pressure from the top chamber 210 to increase, thereby closing the valve.

In reference to FIG. 3, the emptying of the top chamber of the valve 90 can be done from three directions, all of which could be operated independently from each other. The first is to make the normally closed solenoid valve 84 operate which becomes open and releases the pressure of the top chamber. The second is to allow the opening of the pneumatic actuator 100. Because the normally open solenoid valve 80 is not activated, the pressure in the top chamber is evacuated. The pneumatic actuator 100 is operated by an air pressure drop caused by the opening of an automatic sprinkler 110 or by the activation of the pressure operated release valve 98. The third is to manually activate the manual emergency station 96.

In normal supervisory mode, the system shown in FIG. 3 has the automatic sprinkler 110 network supervised by air. The supervision of the air network is used in all cases when sprinkling is not wanted in case of an accidental breaking of a sprinkler head 110, or to have fire protection in areas subject to freezing conditions. The air inlet supplies the required air pressure starting from the check valve 92 to the automatic sprinkler network 218. A pressure switch 18 transmits the status of the air pressure of the system to the electric control module. The air pressure of the system causes the closing of the pneumatic actuator 100, which prevents the tripping of the flow control valve 90 when the air pressure is maintained inside the air line network 216.

The top chamber of the flow control valve 90 is pressurized by the water controlled by the priming valve 104 attached to the water inlet of the main valve 94. The check valve 108 permits the automatic priming of the valve 90 in case the priming valve 104 is closed once the system is in operation. The initial priming of the system should be done with the main water inlet valve 94 in the closed position. Once the pressure is built in the top chamber of the flow control valve 90, the main water valve 94 can be opened, thereby making the system operational. A switch 26, attached to the main water valve 94, transmits the position of the main water valve 94 to the electric control module.

Let us assume for instance the opening of an automatic sprinkler head 110. The system air pressure drops and the pressure switch 18, connected to the air line, detects this pressure drop and transmits its status to the electric control module. Since no alarm has been received from the detectors, the module therefore immediately activates the normally opened solenoid valve 80 and it now becomes closed. With the air pressure continuously dropping, the pneumatic actuator 100 opens. The water released by the opening of the pneumatic actuator 100 is then immediately blocked by the normally opened solenoid valve 80 and the flow control valve 90 does not yet open.

Let us now suppose that there would be fire detection by a detector 8 connected to the electric control module. The module immediately commands the deactivation of the normally opened solenoid valve 80 and the activation of the normally closed solenoid valve 84. The water pressure maintained in the top chamber of the flow control valve 90 is released. The ⅛" restriction orifice 106 allows the water to enter the top chamber of the flow control valve 90, but at a rate much less than what is being evacuated. The pressure therefore cannot be equalized in the top chamber, thereby permitting the flow control valve 90 to open.

The pressure at the water outlet of the valve 90 operates a water flow switch 22 which transmits this status to the electric control module. The water pressure at the outlet of the valve 90 also operates the pressure operated release valve 98 which releases the air in the system because the check valve 102 restricts water from entering the air line 216. Because the water pressure is greater than the air pressure, the air pressure could rebuild itself and nullify the functioning of the system if there was no pressure operated release valve 98. The water then enters the automatic sprinkler network 218 and extinguishing is performed by the automatic sprinkler head 110 which has been opened.

When the closing of the system is required, there is then deactivation of the normally closed solenoid valve 84 and activation of the normally opened solenoid valve 80. The pressure is then rebuilt inside the top chamber of the flow control valve 90, then the valve 90 closes and sprinkling stops. A subsequent fire detection will once again cause another sprinkling cycle.

The main part of the electrical section shown in FIG. 1 is an electronic control module. This control module is connected to the fire alarm system by a control bus which includes all control lines, namely: trouble, alarm, subsequent alarm, reset, etc. All the detection, supervisory and activation circuits are connected to the fire alarm system control bus. Depending upon the circuit concerned, trouble, alarm or subsequent alarm signals can be transmitted to the control module of the alarm system. In return, the control module supplies the power to each circuit, the reset and the lamp test control.

Two detection zones, A 4 and B 6, can each accommodate low voltage type detectors. The types can be of ionization, photoelectric, infra-red, ultra-violet type, etc. Zones A 4 and B 6 can also accommodate dry contact devices such as thermal detectors, pull stations, etc., and can be programmed in a way so as to be not locked-in upon activation of a detector. The return to normal of a detector resets the detection zones 4 or 6 to their initial states of supervision. Detection zone A 4 can be programmed to receive normally closed dry contact devices.

The alarm signals of detection circuits of zones A 4 and B 6 are directed to the unit 28 which determines the detection mode when a zone is activated by the operation of a thermal 8 or ionization 10 detector. The designation of these types of detectors 8 and 10 is for reference only, since each zone 4 or 6 can use any type of detector.

Three detection modes can be selected. One gives a detection validation when at least one of the two detection zones A 4 or B 6 is activated. Another gives a detection validation on zone A 4 only, making zone B 6 used only to transmit an alarm to the control module of the fire alarm system. The third mode gives a detection validation when both detection zones A 4 and B 6 are activated. The first mode is defined as being the single zone detection mode, the second one, the priority zone detection mode and the third one, the crossed zone detection mode. For the single and crossed zone detection modes, a prealarm signal 36 is emitted as soon as one of the detection zones A 4 or B 6 is activated.

Following a detection validation, the signal is transmitted to the second stage alarm unit 40 through the OR gate 34, then the unit 30 determines the sprinkling mode. This unit 30 is composed of another input, connected to zone D 16 of the module, the activation of which is done by the detection of an air pressure drop through a pressure switch 18. This unit 30 is composed of two operational modes. The first one causes the mechanical system to function as a preaction single interlock type, and the second one, as a double interlock type. In the single interlock mode, a sprinkling validation will be allowed as soon as a detection validation will be perceived. A functioning of the mechanical system in deluge mode could also be done. In double interlock mode, a sprinkling validation is allowed when there is a detection validation and a drop in air pressure of the mechanical system.

There are three possible options for the external activation unit 32 in relation to external activation input 38. The first makes the system operate as soon as the external activation input 38 is activated. The second uses the external activation input 38 as a global pull station. When the detection mode unit 28 is programmed to give a detection validation on a crossed zone detection, when only one detection zone A 4 or B 6 is activated and that the external activation input 38, connected to a pull station, is also activated, the sprinkling validation performs, even though there is no detection in crossed zone. This is why the prealarm output, coming from the unit related to the detection mode 28, is connected to the unit of options related to the external actuation 32. The third operation mode can only be used if the system allows an automatic sprinkling stop. As soon as a detection validation is effected, a complete sprinkling cycle is performed. At the end of this sprinkling cycle, sprinkling stops, even if there is still a detection of fire. A new sprinkling cycle can only start by the activation of the external activation input 38. The external activation input 38 also activates the second stage alarm output 40 by means of the OR gate 34 when activated.

The sprinkling validation signal from the unit of options in relation to external actuation 32 is sent to the delay device 46, which is a timer. This timer 46 functions as long as its input is activated. If the input is deactivated before the end of the delay, the delay starts over again if another activation appears. This timer 46 also has a reset input connected to the sprinkling abort 60. When the abort station 58 is activated, the delay of the timer 46, if not terminated, is then initialized. When the abort station 58 is released, the delay of the timer 46 takes over entirely. The delay of this timer 46 can be adjusted from 15 seconds to 1 minute and 45 seconds, in 15 second increments, If no selection is made on the timer 46, the delay before sprinkling is then reduced to zero.

A sprinkling confirmation request signal 52 could be sent as soon as there is a sprinkling validation or as soon as the delay before sprinkling is finished. This signal is transmitted to an equipment 54 which must be stopped before sprinkling is performed. Once this equipment 54 is stopped, it transmits a sprinkling confirmation 56 to the system, thereby allowing the sprinkling Whenever this operation is not necessary, the sprinkling confirmation connection 56 is always activated. The signal at the confirmation connection 56 is transmitted to the sprinkling duration timer 48, as well as the output of the delay before sprinkling timer 46.

The sprinkling duration timer 48 can operate under three functioning modes. The first is to make the sprinkling cycle locked-in as soon as the timer 48 is energized. To make the cycle locked-in, do not make any setting to the timer 48. The timer setting can be adjusted from 30 seconds to 15 minutes and 30 seconds, by 30 second increments. As soon as a setting is selected, the timer 48 can then operate under two functioning modes. In both cases, the timer 48 output is activated as soon as the input is activated. In one instance, as soon as the timer 48 input is deactivated, the cycle of the timer 48 starts. If the input once again becomes activated, the timer 48 cycle is reset until the input is once again deactivated. The second functioning mode of the timer 48 starts the timer cycle as soon as the input is activated. At the end of this cycle, if the timer 48 input is still activated, another cycle, of the same duration as the previous one, takes over. If, at the end of the cycle, the input is deactivated, the timer cycle terminates. The last mode allows the use of a cycle counter 50. Each time a timer cycle is over, an impulse is sent to the cyclic counter 50. As soon as the number of cycles reaches the amount selected by the counter 50, the counter 50 output will be deactivated. The counter 50 allows from 1 to 15 sprinkling cycles. When no selection is made on the counter 50, the amount of cycles is then unlimited.

If the sprinkling confirmation signal at the connection 56 does not allow sprinkling, the timer 48 cycle is then frozen until this input connection 56 allows sprinkling. This timer 48 can optionally be reset by the unit 62 which allows a sprinkling stop by abort. The activation of the abort station 58 during the cycle of the sprinkling duration timer 48 resets the timer 48. Upon the release of the abort station 58, provided the timer 48 input is still activated, the timer cycle starts again.

The output of the counter 50 and the sprinkling duration timer output, as well as the external confirmation input connection 56, are directed to a AND gate 64. All these signals must be activated to allow sprinkling. If one input only of the AND gate 64 is not activated, then the output of this same AND gate 64 is not activated, and sprinkling will not be performed.

The output of the AND gate 64 activates the locked-in unit 66. The output of this unit 66 is normally deactivated. As soon as the input of this unit 66 is activated, the output becomes activated and remains this way even if the input again becomes deactivated. The output of this unit 66 is then sent to another AND gate 68 from which the other input of this gate 68 comes from an OR gate 70. This gate 70 receives the trouble signals coming from the detection zones A 4 and B 6 which, upon activation, can optionally allow sprinkling by a trouble activation only if a sprinkling has already been performed. The locked-in unit 66 has its output also directed to the unit 32 concerning the options related to the external activation. This activation permits the use of the sprinkling mode on only one detection cycle, and the others by the activation of the external activation input 38 whose function has been described above. The output of this unit 66 is also connected to the delay before sprinkling timer 46 resetting the delay of this timer 46 as soon as a cycle has been completed. The delay before sprinkling then becomes instantaneous upon new detections.

The output of the AND gate 64 is also directed to an OR gate 72 whose output allows the activation of the solenoid valve activating unit 76. The output of this gate 72 also activates the sprinkling output 42 by means of the OR gate 74. The solenoid valves control unit 76 controls only one solenoid valve 80 or 84 at one time. In normal mode of supervision of the mechanical system, neither of the solenoid valves 80 or 84 is activated. Upon sprinkling request, only the normally closed solenoid valve 84 is activated. Upon sprinkling termination, the normally closed solenoid valve 84 is deactivated, leaving control to the normally open solenoid valve 80. If another sprinkling is required, the transfer is effected once more from the normally open solenoid valve 80 to the normally closed solenoid valve 84. In supervision mode of the mechanical system, the detection of an air pressure drop by zone D 16 upon activation of the pressure switch 18 provokes the activation of the normally open solenoid valve 80. Upon the return to normal of the air pressure, zone D 16 is deactivated, and the normally open solenoid valve 80 is also deactivated.

Each of the solenoid valves 80 and 84 is supervised by its corresponding actuator 78 or 82. Upon activation of one of these solenoid valves 80 or 84, the activated solenoid valve concerned, 80 or 84, is then energized by the DC power source 86. This power source 86 is supervised by the module for wire breakage or polarity inversion by the supervision unit 88 of the DC power source 86.

During a sprinkling, the activation of the flow control valve 90 is detected by a water flow switch 22 connected to zone E 20 of the module. Where the control of the flow control valve 90 is done by a manual emergency release before the detection appears, this switch 22 allows the transmission of a signal by the second stage alarm output 40 through the OR gate 34 and through the activation of a sprinkling output 42 through another OR gate 74. Manual release of the flow control valve 90 can be done near the flow control valve 90 by an emergency station 96 or by the electrical pull station 14 connected to the electronic module. In both cases, sprinkling is activated immediately and has priority over all the automatic sprinkling modes mentioned earlier.

A sprinkling stop can also be done automatically. If however, sprinkling is locked-in when activated, a sprinkling stop can be done by closing the main water valve 94 located upstream of the flow control valve 90. The closing of this valve 94 will cause the activation of the supervisory switch 26 and a trouble signal will be emitted to the fire alarm system through the control bus 5.

Figure 6:
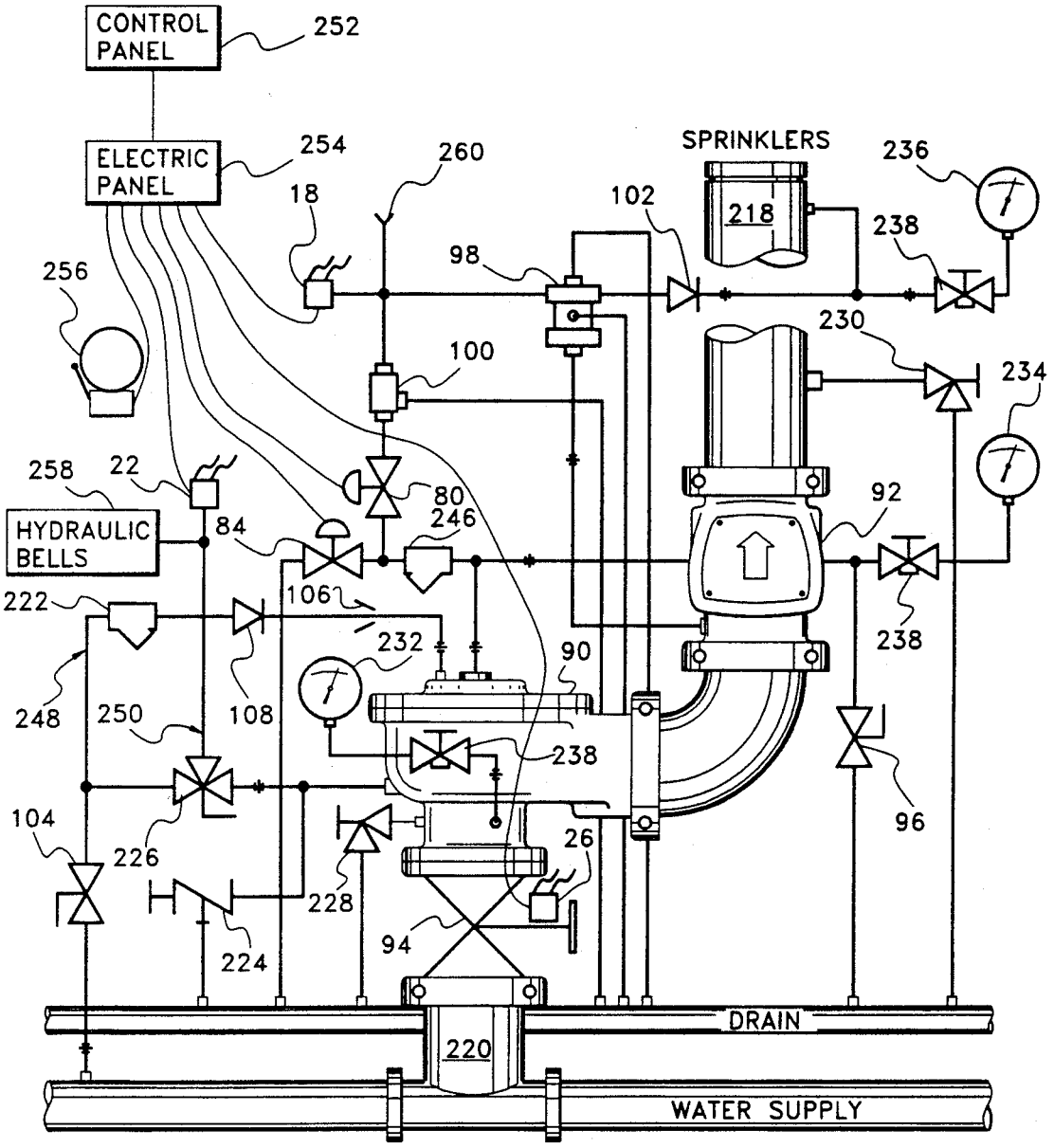
FIG. 6 is a schematic diagram illustrating another embodiment of the mechanical section shown in FIG. 1.
Figure 7:
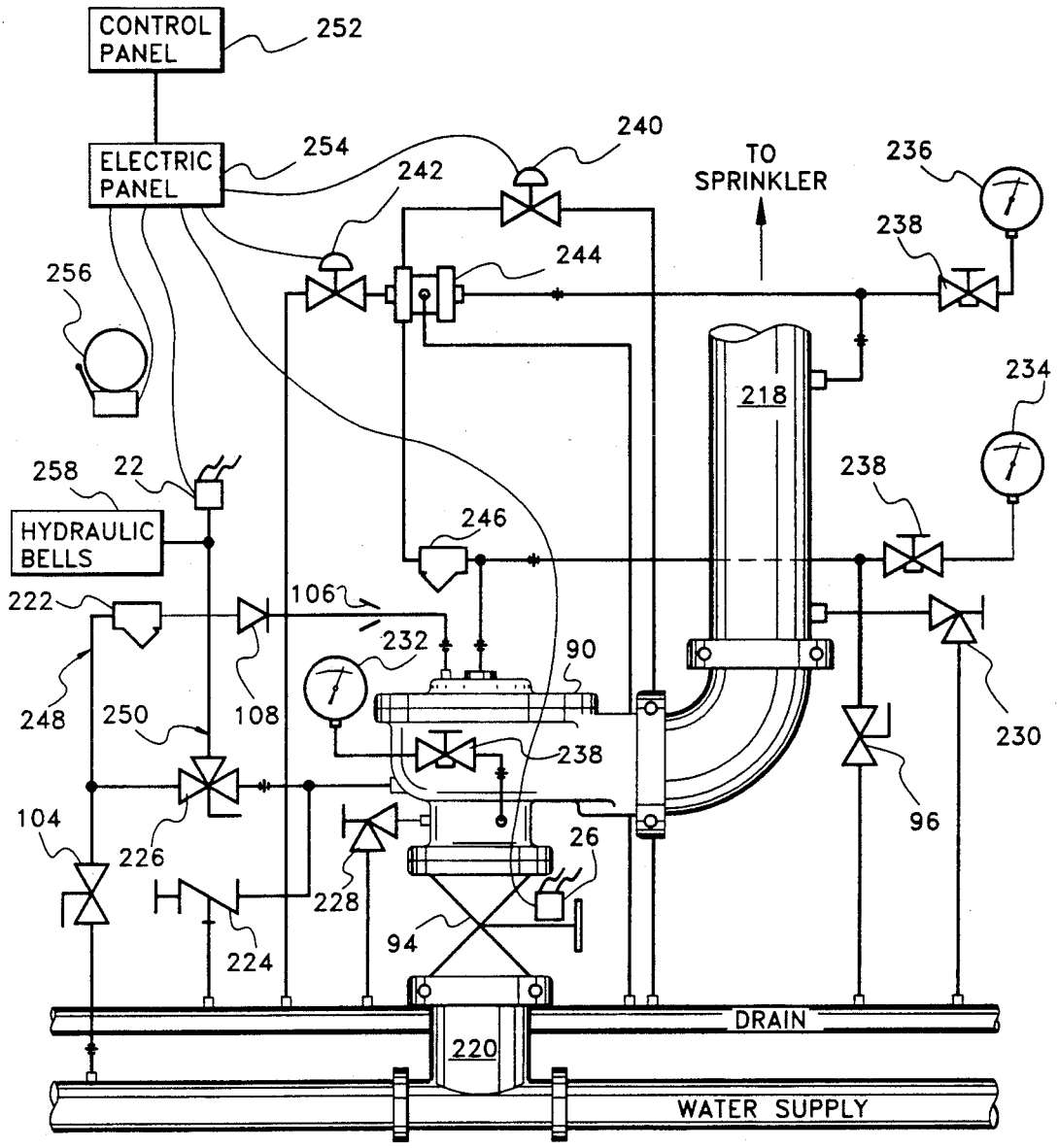
FIG. 7 is a schematic diagram illustrating another embodiment of the mechanical section shown in FIG. 1.

FIGS. 6 and 7 represent installation diagrams, including all devices connected to the fire protection system. FIG. 6 is associated with a preaction system and FIG. 7, to a deluge system. Description of the following elements is the same for both figures.

The flow control valve 90 is connected to the water inlet 220 by the main water control valve 94. The status of the control valve 94 is supervised by a tamper switch 26 in order to transmit a trouble signal to the control panel 252 via the panel 254 for electrical connections, when valve 94 is not in a fully open position.

The top chamber of the flow control valve 90 is pressurized by a priming line 248 controlled by the priming valve 104. Check valve 108 prevents the water evacuation from the top chamber of the flow control valve 90 through the priming line 248, when there is a pressure drop in water inlet 220. A restriction orifice 106 limits the amount of fill to the top chamber of the flow control valve 90 in order not to maintain pressure inside the top chamber of the flow control valve 90 when the manual emergency release 96 or the normally closed and normally opened solenoid valves 84 and 80 (FIG. 6) or 240 and 242 (FIG. 7) are open to allow the opening of flow control valve 90. A strainer 222 filters the impurities in the water inlet 220 for proper operation of check valve 108 and restriction orifice 106.

The alarm test valve 226 allows the verification of the alarm line 250 via electrical bells 29 commuted by alarm switch 22 or by hydraulic bells 258. Three positions are defined by this valve 226. The first totally deactivates alarm line 250. A second one allows the verification of alarm line 250. A final one allows the activation of alarm line 250 when flow control valve 90 is activated. A ball drip check valve 224 automatically empties alarm line 250 when the flow control valve 90 closes. This ball drip check valve 224 is maintained closed as long as flow control valve 90 is opened.

A drain test valve 228 allows the verification of the flow of the water inlet 220 confirming that there is no obstruction in the water inlet 220 leading to flow control valve 90. This verification is made by the reading on gauge 232 indicating the water pressure at inlet 220 and the reading on gauge 234 indicating the pressure in the top chamber of the flow control valve 90. A large variation of readings between both gauges indicates that water inlet 220 is obstructed. A three way valve 238 for each gauge when closed permits the replacement of a gauge.

A manual emergency release 96 manually drains the top chamber of the flow control valve 90 which permits the opening of the flow control valve 90.

A drain valve 230 drains the feed line 218 of automatic sprinklers (not shown in FIGS. 6 and 7) after there has been filling of the piping connected to the feed line 218.

For a preaction system such as FIG. 6, the feed line 218 the piping for the automatic sprinklers is air supervised. The air is received by the air inlet 260, delivered to the feed line 218 of the sprinklers through check valve 102 and contained from check valve 92 to the automatic sprinklers. The air pressure maintains the pneumatic actuator 100 in a closed position as long as the pressure is sufficient.

The top chamber of the flow control valve 90 is maintained under pressure by the closing of the normally closed solenoid valve 84, of the pneumatic actuator 100 and of the manual emergency release 96. The operation of the normally closed solenoid valve 84 or the manual emergency release 96, causes the emptying of the top chamber of the flow control valve 90, which consequently opens this valve 90.

An air pressure drop in the feed line 218 connected to the automatic sprinklers causes the activation of air pressure switch 18. This immediately closes the normally opened solenoid valve 80. The constant air pressure drop will open the pneumatic actuator 100, but the top chamber of the flow control valve 90 cannot be emptied since the normally opened solenoid valve 80 is closed. If the control panel 252 no longer has power, the normally open solenoid valve 80 will not be adequately supplied, and the flow control valve 90 will open. The strainer 246 protects the pneumatic actuator 100 and the normally closed and normally open solenoid valves 84 and 80 from impurities coming from the water contained inside the top chamber of the flow control valve 90.

The pressure operated relief valve 98 is released as soon as the flow control valve 90 opens. This valve 98 prevents rebuilding of air pressure between the air inlet 260 and the check valve 102 when water is delivered to the automatic sprinklers. This prevents building up of pressure inside the top chamber of the flow control valve 90 when the normally closed and normally open solenoid valves 84 and 80 cannot be powered, thereby closing the flow control valve 90; following the closing of this valve 90, the air pressure drops and would once again cause the opening, and eventually the closing of the flow control valve 90 in a successive manner.

When the flow control valve 90 is opened, the activation of the normally open solenoid valve 80, considering that the normally closed solenoid valve 84 and the manual emergency release 96 are closed at this time, will cause the pressurization of the top chamber of the flow control valve 90. This causes the flow control valve 90 to close.

The check valve 102 prevents water from infiltrating the air inlet 260 when the flow control valve 90 is opened. The gauge 236 indicates the air pressure when the feeding line 218 of the automatic sprinkler is air supervised, as well as the water pressure when the flow control valve 90 is opened. A gauge test valve 238 when closed permits the replacement of gauge 236 without emptying the piping.

For a deluge system such as FIG. 7, the sprinkler piping is at atmospheric pressure.

The top chamber of the flow control valve 90 is maintained under pressure by the closing of the normally closed solenoid valve 240 and the manual emergency release 96. The operation of the normally closed solenoid valve 240 or the manual emergency release 96 causes the draining of the top chamber of the flow control valve 90, consequently the opening of this valve 90.

The pressure operated relief valve 244 is released as soon as the flow control valve 90 is opened. This valve 244 prevents the pressure of the top chamber of the flow control valve 90 to rebuild when the flow control valve 90 is opened.

It is possible however to rebuild the pressure inside the top chamber of the flow control valve by deactivating the normally closed solenoid valve 240 and by activating the normally open solenoid valve 242. With all sources of evacuation of the top chamber of the flow control valve 90 being closed at this moment, said flow control valve 90 closes.

The feed line 218 of the sprinkler network being at the atmospheric pressure, a zero pressure will appear on the gauge 236. When the flow control valve 90 is opened, gauge 236 will indicate the water pressure of the network 218.

Although the present invention has been explained hereinabove by way of a preferred embodiment thereof, it should be pointed out that any modification to this preferred embodiment, within the scope of the appended claims, is not deemed to change or alter the nature and scope of the present invention.

What is claimed is:

1. A electronic fire reporting and sprinkling control module for connection to a control bus of a fire alarm system, and to a flow control valve which controls flow of extinguishing fluid into a sprinkler system, said sprinkler system covering a particular area to be protected, comprising:

a bus connection for connection to said control bus for receiving and transmitting information from and to said fire alarm system;

detector input connections for connection to at least one group of detectors for monitoring said area covered by said sprinkler system;

an air pressure detector connection for connection to an air pressure detector for providing a status signal representative of pressure inside said sprinkler system when monitored by pressurized air;

a detection mode unit having inputs connected to said detector input connections, and an output for generating an alarm signal when pre-selected inputs of said detection mode unit are activated;

a pre-programmed sprinkling mode unit having a first input connected to the output of said detection mode unit, a second input connected to said air pressure detector connection, and an output for generating a sprinkler signal according to a pre-programmed operation mode and said status signal present at said air pressure detector connection;

a timer having an input for receiving an initiating signal derived from said sprinkler signal, and an output for initiating sprinkling periods as along as its input is activated; and a valve control unit having a first input for receiving an output signal from said timer, and an output for activating said flow control valve, whereby information concerning a fire emergency is directly transmitted to said alarm system by means of said control bus, whereby fire emergency conditions in said area are set by means of said at least one group of detectors and said detection mode unit, and whereby automatic sprinkling periods are programmed by means of said timer.

2. A module according to claim 1, wherein said detector input connections and said air pressure detector connection are connected to said bus connection, said module further comprising:

an emergency input connection for connection to an emergency pull station, said emergency input connection being connected to said bus connection;

a waterflow input connection for connection to a flow sensor for monitoring flow of fluid inside said sprinkler system, said waterflow input connection being connected to said bus connection; and a valve supervisory input connection for connection to a valve supervising switch monitoring a main valve for controlling access of said extinguishing fluid to said flow control valve, said valve supervisory input connection being connected to said bus connection, whereby said fire alarm system is informed of different operating statuses.

3. A module according to claim 2, further comprising a cyclic counter having an input connected to said timer for counting each of said sprinkling periods, and an output connected to a second input of said valve control unit, whereby a stop of sprinkling after a predetermined amount of said sprinkling periods is programmed by means of said counter.

4. A module according to claim 3, for connection to normally open and closed solenoid valves for controlling said flow control valve, wherein said valve control unit comprises:

a first AND gate having inputs constituting said first and second inputs of said valve control unit;

a locked-in upon activation unit having an input connected to an output of said first AND gate;

a second AND gate having a first input connected to an output of said locked-in upon activation unit, a second input connected to an output of a first OR gate which has inputs connected to said detector input connections, and an output;

a second OR gate having a first input connected to said output of said first AND gate, a second input connected to said output of said second AND gate, a third input connected to said emergency input connection, and an output;

a solenoid valve activating unit having a first input connected to said output of said second OR gate, a second input connected to said air pressure detector connection, a first output for activating a normally open solenoid valve actuator, and a second output for activating a normally closed solenoid valve actuator, whereby said solenoid valves are controlled by said valve control unit according to different conditions determined by signals present on said detector input connections and said air pressure connection and by signals derived from said sprinkler signal.

5. A module according to claim 4, further comprising:

a direct current power input connection to be connected to a direct current power source, said direct current power input connection being connected to each of said valve actuators by which their corresponding solenoid valve can be energized by said direct current power source when activated; and a power source supervision unit having an input connected to said direct current power input connection, and an output connected to said bus connection by which said control bus is informed of the status of said direct current power input connection.

6. A module according to claim 4, for connection to a special equipment located in said area, said special equipment comprising equipment that must not be sprinkled when in operation, said special equipment comprising means for receiving a request for sprinkling signal and for providing a confirmation signal for indicating that said equipment is not operating and that a sprinkling can be performed; said module further comprising:

a request output connection for receiving a signal derived from said sprinkler signal, that constitutes said request for sprinkling signal; and a confirmation input connection for receiving said confirmation signal from said equipment, said confirmation input connection being connected to a disabling input of said timer, and to a third input of said first AND gate.

7. A module according to claim 4, comprising a time delay device having:

an input for receiving an activating signal derived from said sprinkler signal;

an output connected to said input of said timer to provide said initiating signal;

a by-pass input connected to said output of said locked-in upon activation unit by which said initiating signal of said timer has substantially no time delay with respect to said activating signal of said delay device when said by-pass input is activated, and said initiating signal has a predetermined time delay with respect to said activating signal when said by-pass input is not activated; and a reset input for resetting said delay device when activated.

8. A module as defined in claim 7, comprising:

an abort input connection for connection to an abort station, said abort input connection being connected to said reset input of said delay device; and a sprinkling abort unit having a first input connected to said abort input connection, a second input connected to said output of said delay device, and an output connected to a reset input of said timer by which a sprinkling can be aborted by activation of said abort station.

9. A flow control valve system for controlling flow of extinguishing fluid into a sprinkler system which is monitored by pressurized air, said system is connected to a sprinkling control module for commanding said flow of fluid into said sprinkler system upon detection of a fire emergency, said flow control valve system comprises:

a main valve having an inlet for receiving said fluid, and an outlet;

a flow control valve having an inlet connected to the outlet of said main valve, and an outlet for connection to said sprinkler system by means of a check valve restricting flow of said pressurized air from said sprinkler system to said flow control valve, said control valve having a body forming a passage between the inlet and the outlet of said control valve, said control valve including movable clapper having a first position in which said passage is blocked, and a second position in which said passage is open, said clapper having a first surface forming with said body a chamber having an inlet and an outlet receiving and exiting respectively pressurized fluid, said clapper having a second opposite surface forming with said body said inlet of said flow control valve, said first surface being at least four times greater than said second surface, said clapper being moved from its second position to its first position by means of said pressurized fluid entering said inlet of said chamber, said clapper being moved from its first position to its second position by releasing pressurized fluid from said outlet of said chamber;

a pressurized air channel having an inlet for connection to a pressurized air source, and an outlet for connection to said sprinkler system by means, respectively, of a pressure operated release valve and a check valve for restricting fluid from circulating from the sprinkler system to the air channel;

a normally closed valve having an end connected to said chamber of said control valve for depressurizing said chamber when activated, said normally closed valve is controlled by said module;

a fluid releasing circuit connected to said chamber, including a normally open valve and a pneumatic actuator which is controlled by air pressure inside the air channel which is connected to said pneumatic actuator, said actuator being closed when said air channel is pressurized and opened when pressure drops inside said air channel, said normally open valve is controlled by said module;

a priming system including a priming valve having an inlet connected to a source of fluid and an outlet connected to said chamber by means of a channel having a portion with a reduced cross-section;

a fluid flow detector and activating means for detecting fluid flow at the outlet of said control valve and activating said pressure operated release valve upon fluid flow detection; and an air pressure detector for indicating to said module that air pressure has dropped under a predetermined level inside said air channel, said normally open and closed valves are connected to said module for controlling said flow control valve upon detection of a fire emergency by said module, whereby upon complete electrical power loss and air pressure drop inside said sprinkler system, said chamber is depressurized thus allowing introduction of extinguishing fluid inside said sprinkler system.

10. A system according to claim 9, wherein, along said fluid releasing circuit, said normally open valve is a solenoid valve and is disposed between said chamber and said pneumatic actuator.

11. A system according to claim 9, wherein said inlet of said priming valve is connected to said inlet of said main valve so that said source of fluid is provided by said inlet of said main valve, said system further comprising a check valve connected between said outlet of said priming valve and said chamber for restricting fluid from circulating from said chamber to said priming valve.

12. A system according to claim 9, further comprising a valve supervisory switch installed onto said main valve and having an output for connection to said module by which said module is informed of the status of said main valve; and a water flow switch having an input derived from said outlet of said flow control valve, and an output for connection to said module by which said module is informed whether fluid has been introduced into said sprinkler system.

13. Method of controlling a flow control valve system that controls flow of extinguishing fluid into a sprinkler system which is monitored by pressurized air, said system is connected to a sprinkling control module which commands said flow of fluid into said sprinkler system upon detection of a fire emergency, comprising steps of:

receiving said fluid by means of a main valve;

sending said fluid from said main valve to an inlet of a flow control valve, an outlet of said flow control valve being connected to said sprinkler system by means of a check valve restricting flow of pressurized air from said sprinkler system to said flow control valve, said flow control valve having a first position in which said fluid is blocked, and a second position in which said fluid is free to flow, said flow control valve being moved from its second position to its first position by means of a pressurized controlling fluid sent to said flow control valve, said flow control valve being moved from its first position to its second position by releasing said pressurized controlling fluid from said flow control valve;

pressurizing said sprinkler system by means of a pressurized air channel including, respectively, a pressure operated release valve for depressurizing said air channel when a flow of said extinguishing fluid is detected at said outlet of said flow control valve, and a check valve for restricting fluid from circulating from the sprinkler system to the air channel;

depressurizing said flow control valve by activating a normally closed valve that releases said pressurized controlling fluid when said fire emergency is detected;

depressurizing said flow control valve by means of a normally open valve connected in series with a pneumatic actuator that is open only when pressure drops inside said air channel, said normally open valve being closed when a reset has been done after said fire emergency;

pressurizing said flow control valve by means of a priming system including a priming valve to send said pressurized controlling fluid to said flow control valve by means of a channel having a portion with a reduced cross-section; and detecting fluid flow at the outlet of said control valve and depressurizing said air channel upon fluid flow detection, whereby upon complete electrical power loss and air pressure drop inside said sprinkler system, said flow control valve is depressurized, thus allowing introduction of extinguishing fluid inside said sprinkler system.

* * * * *